US005915532A

United States Patent [19]

Williams

[11] Patent Number: 5,915,532

[45] Date of Patent: Jun. 29, 1999

[54] DISPOSABLE HEADBAND

[76] Inventor: Ruby B. Williams, 155 6th Ave. North East, St. Petersburg, Fla. 33701

[21] Appl. No.: 09/120,268

[22] Filed: Jul. 22, 1998

[51] Int. Cl.[6] ..... A41D 20/00

[52] U.S. Cl. ..... 2/171; 2/DIG. 11

[58] Field of Search ..... 2/171, 181, DIG. 11, 2/209.3

[56] References Cited

U.S. PATENT DOCUMENTS 1,697,919 1/1929 Knepper ..... 2/171

5,572,745 11/1996 Mainus ..... 2/DIG. 11

*Primary Examiner*—Diana L. Biefeld

*Attorney, Agent, or Firm*—Pendorf & Cutliff

[57] ABSTRACT

A disposable headband that is made from a thin sheet of non-woven material, as absorption strip and a label strip. The non-woven material is absorbent to liquid perspiration. The absorption strip is formed of material readily permeated by liquid perspiration and a liquid absorbing media. The absorption strip is placed onto the thin sheet of non-woven material, where the thin sheet of non-woven material is folded over the absorption strip to encase the absorption strip. Finally, a label strip, comprising a material substantially impervious to liquid perspiration, is adhered to the non-woven sheet for securing the absorption strip therein.

11 Claims, 3 Drawing Sheets

DISPOSABLE HEADBAND

BACKGROUND OF THE INVENTION

1. Field of the Invention

The present invention relates to a disposable headband and more particularly pertains to providing a disposable headband having an absorption media.

2. Description of the Prior Art

The use of headbands is known in the prior art. More specifically, headbands heretofore devised and utilized for the purpose of catching perspiration about the forehead are known to consist basically of familiar, expected and obvious structural configurations, notwithstanding the myriad of designs encompassed by the crowded prior art which have been developed for the fulfillment of countless objectives and requirements.

The disposable headband according to the present invention substantially departs from the conventional concepts and designs of the prior art, and in so doing provides an apparatus primarily developed for the purpose of providing a disposable headband that has an absorption media.

Therefore, it can be appreciated that there exists a continuing need for a new and improved disposable headband which can be used for providing a disposable headband that has an absorption media.

In this regard, the present invention substantially fulfills this need.

SUMMARY OF THE INVENTION

In view of the foregoing disadvantages inherent in the known types of headbands now present in the prior art, the present invention provides an improved disposable headband. As such, the general purpose of the present invention, which will be described subsequently in greater detail, is to provide a new and improved disposable headband which has all the advantages of the prior art and none of the disadvantages.

To attain this, the present invention essentially comprises a thin sheet of non-woven material. The non-woven material has an inner surface and an outer surface with peripheral edges. The sheet of non-woven fabric is absorbent to liquid perspiration. Also, included is an absorption strip. The absorption strip is formed of a material readily permeated by liquid perspiration and a liquid absorbing media. The absorption strip has a first wall centrally positioned adjacent the inner surface of the sheet of non-woven material and a second wall. The thin sheet of non-woven material is folded over the second wall of the absorption strip and completely encases the absorption strip.

A label strip is provided. The label strip is made of a material substantially impervious to liquid perspiration. The label strip has a first surface and a second surface. The first surface has an adhesive. The first surface is adhered to the outer surface of the sheet of non-woven material, when the non-woven material is folded about the absorption strip. The first surface when adhered to the outer surface of the sheet of non-woven material secures the absorption strip therein.

Lastly, the thin sheet of non-woven material has a pair of ends when folded about the absorption strip. Each of the pair of ends has a grommet. Each grommet is in receipt of one end of an elasticized member. The elasticized member, when coupled with the pair of ends of the sheet of non-woven material, supports the sheet of non-woven material about a forehead.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved disposable headband which has all the advantages of the prior art headbands and none of the disadvantages.

It is another object of the present invention to provide a new and improved disposable headband which may be easily and efficiently manufactured and marketed.

It is a further object of the present invention to provide a new and improved disposable headband which is of a durable and reliable construction.

An even further object of the present invention is to provide a new and improved disposable headband which is susceptible of a low cost of manufacture with regard to both materials and labor, and which accordingly is then susceptible of low prices of sale to the consuming public, thereby making such A disposable headband economically available to the buying public.

Still yet another object of the present invention is to provide a new and improved disposable headband which provides in the apparatuses and methods of the prior art some of the advantages thereof, while simultaneously overcoming some of the disadvantages normally associated therewith.

Still another object of the present invention is to provide a disposable headband with an absorption media and a label with advertising.

Lastly, it is an object of the present invention to provide a new and improved disposable headband that is made from a thin sheet of non-woven material, as absorption strip and a label strip. The non-woven material is absorbent to liquid perspiration. The absorption strip is formed of material readily permeated by liquid perspiration and a liquid absorbing media. The absorption strip is placed onto the thin sheet of non-woven material, where the thin sheet of non-woven material is folded over the absorption strip to encase the absorption strip. Finally, a label strip, comprising a material substantially impervious to liquid perspiration , is adhered to the non-woven sheet for securing the absorption strip therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
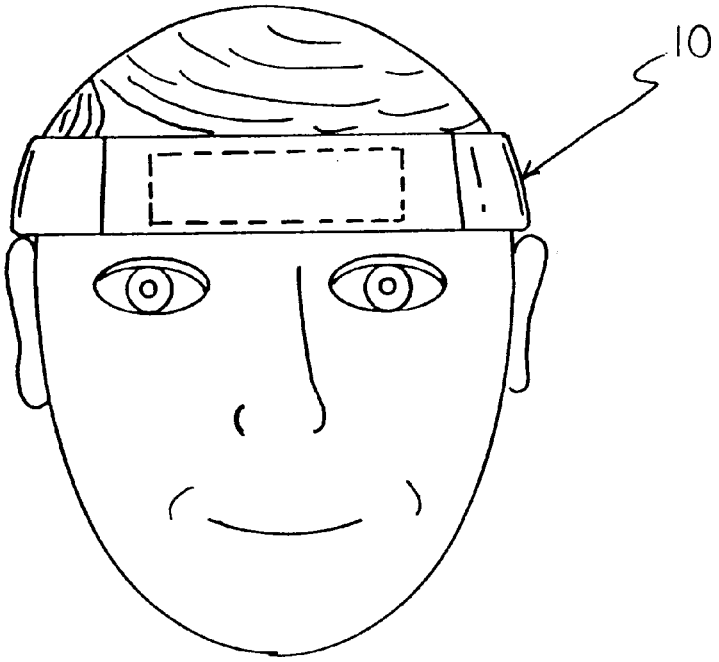
FIG. 1 is a perspective illustration of the preferred embodiment of the disposable headband constructed in accordance with the principles of the present invention.

With reference now to the drawings, and in particular to FIG. 1 thereof, a new and improved disposable headband embodying the principles and concepts of the present invention and generally designated by the reference numeral 10 will be described.

The present invention, is a new and improved disposable headband, is comprised of a plurality of components. Such components in their broadest context include a thin sheet of non-woven material, an absorption strip and a label strip. Such components are individually configured and correlated with respect to each other so as to attain the desired objective.

Figure 6:
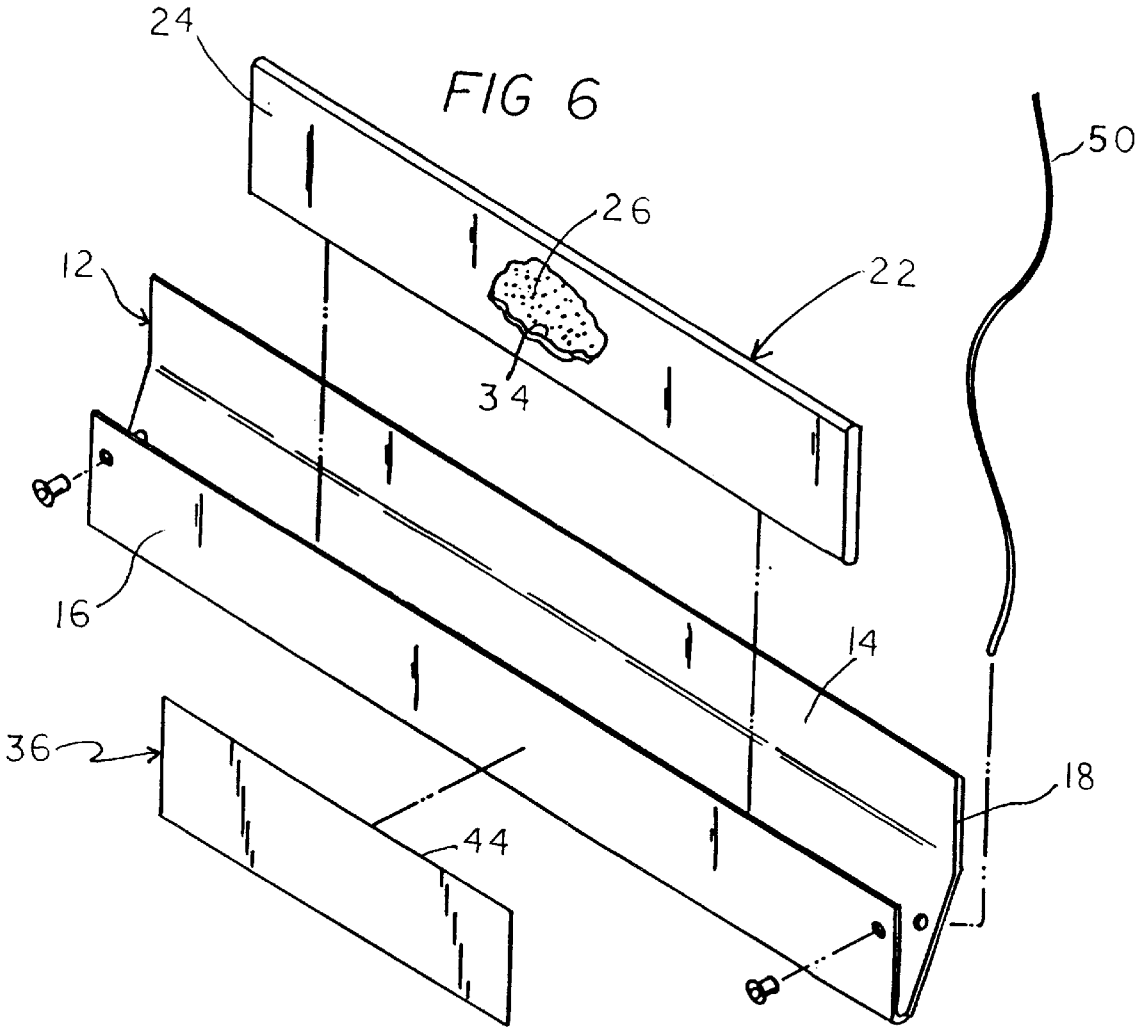
FIG. 6 is an exploded view of the headband showing the operable components.

More specifically, the present invention includes a thin sheet of non-woven material 12. The thin sheet has an inner surface 14, an outer surface 16 and with peripheral edges 18. The thin sheet of non-woven material is shown in FIG. 6. The sheet of non-woven fabric is absorbent to perspiration. The thin sheet of non-woven material is very durable and not easily torn when tugged and pulled. The thin sheet of non-woven material may be formed of absorbent paper or fabric and may be a mesh.

Figure 4:
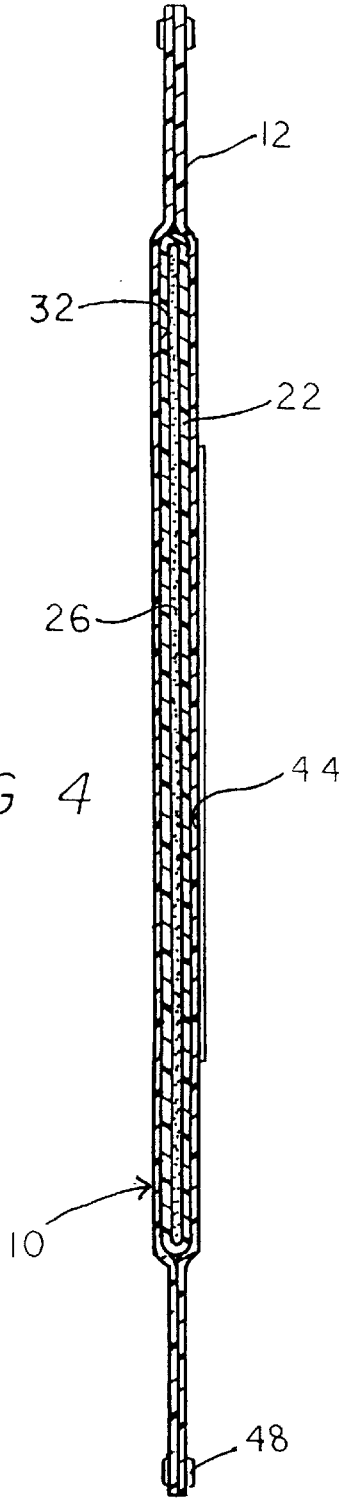
FIG. 4 is a cross-sectional view of the headband taken along lines 4—4 of FIG. 3.
Figure 5:
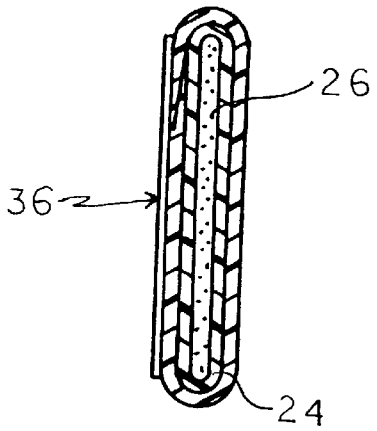
FIG. 5 is a cross-sectional view of the headband taken along lines 5—5 of FIG. 3.

Included is an absorption strip 22. The absorption strip is. formed of a material 24 readily permeated by perspiration and a liquid absorbing media 26. As shown in FIG. 4, the absorption strip has a first wall 32 centrally positioned and adjacent the inner surface 14 of the sheet of non-woven material. The absorption strip has a second wall 34, shown in FIG. 6.

The absorbent media, as shown in FIG. 6, placed within the material is crystals of highly absorbent material such as a potassium or sodium polyacrylate which is a polymer of an acrylic acid or a polyacylamide. Each of these polymers absorbs an extremely large amount of liquid relative to its weight in the order of approximately 30 times. Also, other less effective materials may be used. Such less effective absorbent materials are desiccators and other liquid absorbing silica gels. Because of the high absorption ability of the crystals, a relatively small amount of the crystals are used within the absorption strip. In use, the thin sheet of non-woven material is folded over the second wall of the absorption strip and completely encases the absorption strip.

Figure 2:
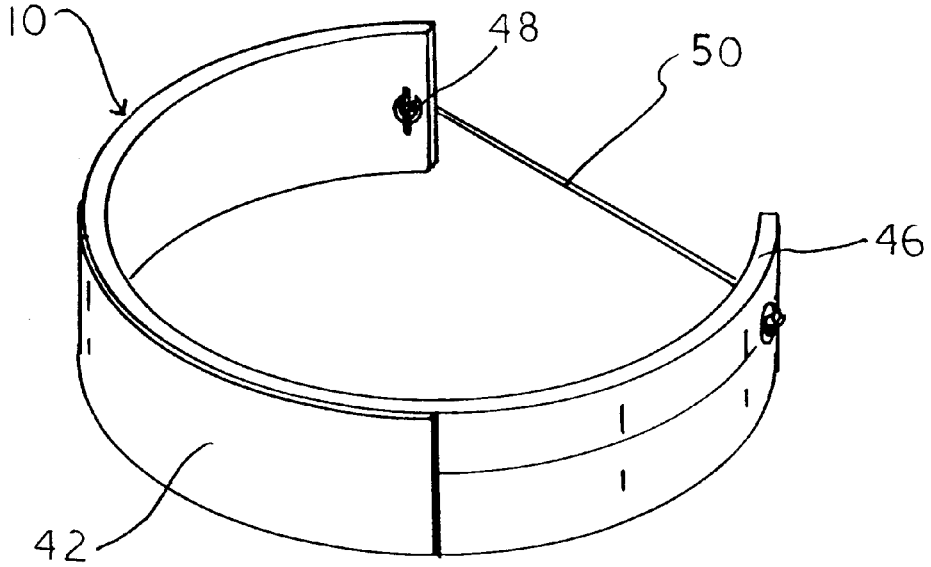
FIG. 2 is an isometric view of the headband.
Figure 3:
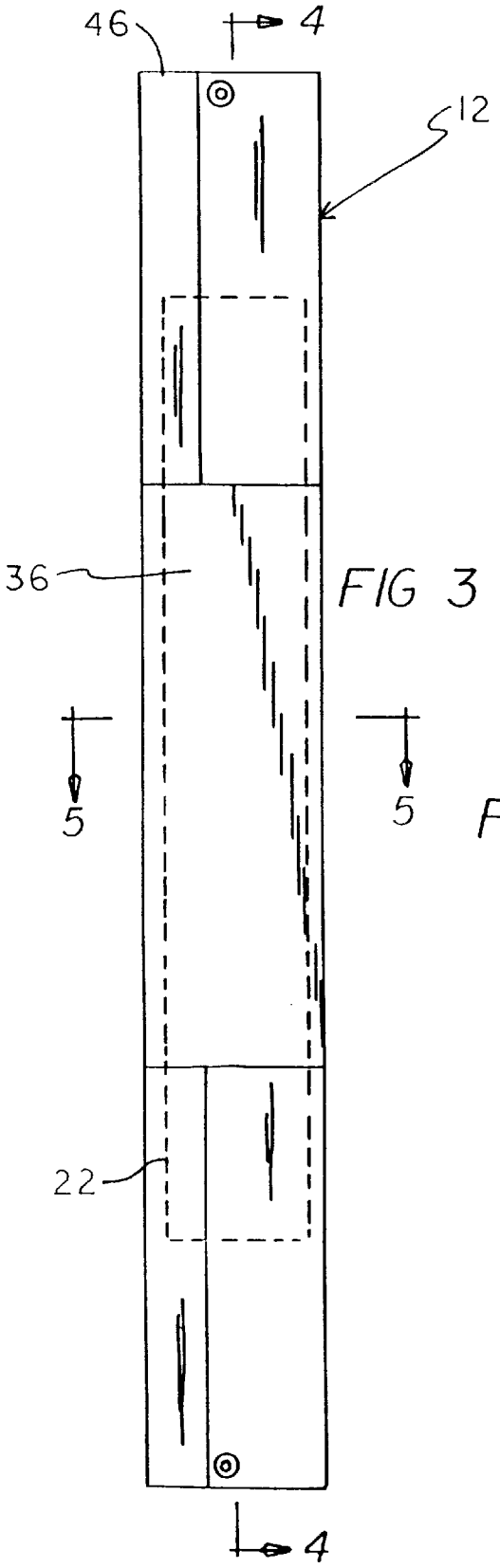
FIG. 3 is a frontal view of the headband.

Additionally, a label strip 36 is provided. The label strip, as shown in FIGS. 1 and 2, is comprised of a material substantially impervious to liquid perspiration. The label strip is preferably made of a polyethylene or other plastic material impervious to liquids such as perspiration. The label strip has a first surface 42 and a second surface 44. The first surface has an adhesive that is water insoluble. The first surface is adhered to the outer surface 16 of the sheet of non-woven material when the non-woven material is folded about the absorption strip. FIG. 3 shows the label strip as positioned on the non-woven sheet. The first surface, when adhered to the outer surface of the sheet of non-woven material, secures the absorption strip within the sheet of non-woven material.

The thin sheet of non-woven material 12, when folded about the absorption strip, forms a pair of ends 46. Each of the pair of ends has a grommet 48 placed therethrough. In FIG. 2, each grommet is shown to be in receipt of one end of an elasticized member 50. The elasticized member, when coupled with the pair of ends of the sheet of non-woven material, supports the sheet of non-woven material about a forehead, as depicted in FIG. 1.

In use the headband 10 as shown in FIG. 1 is worn around the head of a person. The label strip may have the logo of a company imprinted thereon. When the wear places the headband around their head, it remains in place with the elasticized member. Once the absorption strip has expanded from the perspiration absorbed by the absorption media the headband in disposed of and replaced.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A disposable headband for absorption of perspiration comprising, in combination:

a thin sheet of non-woven material having an inner surface and an outer surface with peripheral edges therearound, the sheet of non-woven fabric being absorbent to liquid perspiration;

an absorption strip formed of a material readily permeated by liquid perspiration and a liquid absorbing media, the absorption strip having a first wall centrally positioned adjacent the inner surface of the sheet of non-woven material and a second wall, the thin sheet of non-woven material being folded over the second wall of the absorption strip and completely encasing the absorption strip;

a label strip comprising a material substantially impervious to liquid perspiration, the label strip having a first surface and a second surface, the first surface having an adhesive thereon, the first surface being adhered to the outer surface of the sheet of non-woven material and the non-woven material being folded about the absorption strip, the first surface when adhered to the outer surface of the sheet of non-woven material securing the absorption strip therein; and the thin sheet of non-woven material having a pair of ends when folded about the absorption strip, each of the pair of ends having a grommet, each grommet being in receipt of one end of an elasticized member, the elasticized member, when coupled with the pair of ends of the sheet of non-woven material, being adapted to support the sheet of non-woven material about a wearer's forehead.

2. The disposable headband as set forth in claim 1, wherein the liquid absorbing media within the absorption strip comprises solid crystals.

3. The disposable headband as set forth in claim 2, wherein the liquid absorbing media is crystals of polyacrylate.

4. The disposable headband as set forth in claim 2, wherein the liquid absorbing media is crystals of polyacylamide.

5. A disposable headband comprising:

a thin sheet of non-woven material being absorbent to liquid perspiration;

an absorption strip formed of a material readily permeated by liquid perspiration and a liquid absorbing media, the absorption strip being placed onto the thin sheet of non-woven material, the thin sheet of non-woven material being folded over the absorption strip to encase the absorption strip; and a label strip comprising a material substantially impervious to liquid perspiration being adhered to the non-woven sheet for securing the absorption strip therein.

6. The disposable headband as set forth in claim 5, wherein the thin sheet of non-woven material has an inner surface and an outer surface with peripheral edges therearound, the sheet of non-woven material having a pair of ends when folded about the absorption strip, each of the pair of ends having a grommet, each grommet being in receipt of one end of an elasticized member, the elasticized member, when coupled with the pair of ends of the sheet of non-woven material, being adapted to support the sheet of non-woven material about a wearer's forehead.

7. The disposable headband as set forth in claim 6, wherein the label strip has a first surface and a second surface, the first surface having an adhesive thereon, the first surface being adhered to the outer surface of the sheet of non-woven material and the non-woven material being folded about the absorption strip.

8. The disposable headband as set forth in claim 5, wherein the absorption strip has a first wall centrally positioned adjacent the inner surface of the sheet of non-woven material and a second wall.

9. The disposable headband as set forth in claim 5, wherein the absorbing media is solid crystals.

10. The disposable headband as set forth in claim 5, wherein the absorbing media is crystals of polyacrylate.

11. The disposable headband as set forth in claim 5, wherein the absorbing media is crystals of polyacylamide.

* * * * *